United States Patent [19]

Ruf

[11] Patent Number: 5,020,170

[45] Date of Patent: Jun. 4, 1991

[54] BED FOR IMMOBILE PATIENTS

[76] Inventor: Hermann Ruf, Pfutzenstr. 54-58, D-6103, Darmstadt-Griesheim, Fed. Rep. of Germany

[21] Appl. No.: 375,812

[22] Filed: Jul. 5, 1989

[30] Foreign Application Priority Data

Jul. 5, 1988 [DE] Fed. Rep. of Germany ..... 3822723
Jul. 16, 1988 [DE] Fed. Rep. of Germany ..... 3824203

[51] Int. Cl.[5] ..... A61G 7/06

[52] U.S. Cl. ..... 5/61; 5/13; 5/109

[58] Field of Search ..... 5/61, 63, 108, 109; 128/33

[56] References Cited

U.S. PATENT DOCUMENTS

| | | | |
|---|---|---|---|
| 949,655 | 2/1910 | May | 5/63 |
| 1,185,054 | 5/1916 | Buckley | 5/61 |
| 2,520,563 | 8/1950 | Preston | 5/109 |
| 3,302,218 | 2/1967 | Stryker | 5/61 |
| 3,587,482 | 6/1971 | Wieland | 5/63 X |
| 3,590,812 | 7/1971 | Larson | 128/33 |
| 3,737,924 | 6/1973 | Davis | 5/61 X |
| 4,852,193 | 8/1989 | Alsip et al. | 5/61 |

FOREIGN PATENT DOCUMENTS

| | | | |
|---|---|---|---|
| 753793 | 3/1967 | Canada | 5/63 |

*Primary Examiner*—Michael F. Trettel
*Attorney, Agent, or Firm*—Herbert Dubno

[57] ABSTRACT

A bed for immobile patients includes a height-adjustable bed frame mounted on a sub-structure provided with at least two spaced apart and connected with one another pivotable sectors driven by a flexible element passing through a plurality of rollers and fixed to extremeties of at least one sector and with a rail having a form of an arcuate of U-shaped depression running along at least one side of each sector and receiving guiding elements rotatably mounted on stands juxtaposed with the sectors.

11 Claims, 8 Drawing Sheets

BED FOR IMMOBILE PATIENTS

FIELD OF THE INVENTION

My present invention relates to a bed for immobile patients and, more particularly, a drive system for pivoting beds having a plurality of circular segments and a support system providing a smooth and safe changing of a patient's position.

BACKGROUND OF THE INVENTION

Numerous types of beds for immobile patients are known. A drawback all of them have in common is complicated structure and the inability to change a patient's position as frequently as necessity might require it.

Pivoting beds are most frequently used for such patients. Along with the advantage of a slow backward and forward movement of a bed frame ensuring a continuous and gradual change of the patient's position, the cumbersome structure of the frame poses a big problem. Additionally, movable sections of this bed are driven by means of a V-belt which has a tendency to slip and can cause discomfort of the patient.

Another type of bed is a roller-segment-shaped disk provided with depressions in a bed frame. Such a structure is described in a German Patent Document DB GM 8716370.5.

The use of bed sub-structures consisting of one or several segments of a circle to permit pivoting mounting of the bed frame has also already been proposed. Such sub-structures provide, as compared to other designs, the advantage that the bed frame can be integrated and that the design is both practical and easily transportable.

OBJECTS OF THE INVENTION

It is therefore an object of the present invention to provide a structure of a bed frame affording smooth, jerk-free and said changes in position of an immobile patient.

Yet another object is to provide a bed with a compact and simple structure.

Still, another object is to provide a bed having a structure capable of adjusting according to individual features of a patient.

SUMMARY OF THE INVENTION

These objects and others which will become more readily apparent hereinafter are attained in accordance with the invention in a bed including one or several disks and segments pivotable by means of a guiding flexible element connected thereto and driven by a group of wheels and/or rollers.

The segments can be either a segment of a circular arc or a segment of a circle, or disks forming a bed frame and provided with recesses having generally a U-shape cross section and running along opposite sides in an arc of at least one segment and with a trough extending across the arc. The trough receives a chain, preferably, a roller chain, a pull-cable or a toothed belt fixed to ends of a segment and running over a few, preferably three, wheels or rollers adjacent located below the segment. One of the rollers is driven. The utilization of such a system of rollers provides a smooth transition of positions of a segment.

Each of the segments is juxtaposed with at least one stand provided with a plurality of pins arranged in an arc configuration and engaging the respective segment through respective ball bearings or the like mounted in a respective rail formed by means of a U-shaped depression formed on at least one side of each of the segments. Thereby, the structure utilizes the retention and guidance of the segments.

Stands can be mounted on both sides of a segment.

A chain is displaced by driving means and runs along the circumference of the segment through several chain sprockets including a drive and driven sprockets. A group of chain sprockets ensures continuous and uniform tensioning of the chain providing a smooth pivoting of a segment.

Another important consequence of the structure is a reduction of wear ensuing from the fact that a large number of teeth of sprockets, approximately ten, engage the chain simultaneously.

The driving system including a chain and sprockets can be replaced by a pull-cable with three or more rollers. In this case the cable can be wound around a driving roller several times.

Instead of a pull-cable a toothed belt formed with teeth on either one or both sides can be utilized. By using a belt with teeth formed on one side only a driving roller will take a form of a toothed-belt sprocket, while other rollers will be used for reversal. When teeth are provided on both sides toothed-belt sprockets are used for the other rollers.

The driving means can include a motor mounted at a foot of the bed and regulating a speed of a reciprocating motion of the bed. Advantages of the structure allow an adjustment of the speed of the motor by both clinical personnel or a patient.

In accordance with an experimental use of the bed of the invention a segmental arc of 210° have been found advantageous. In this case an angular displacement of a segment may be up to 82°.

Preferably, only one segment of a bed having several segments is driven while other segments can be connected to the driven one by any suitable means as, for instance, spacer rods.

However, the possibility of a structure with a few movable segments is not excluded.

As to individual physical parameters of a patient, the structure of the present invention is equipped with a height adjustable "patient-surface" system supported by a sub-structure of the bed, advantageously, by annular segments supporting crossmembers running in a secant arrangement with a "patient surface" system mounted thereon.

The "patient surface" system includes a support member and a height-adjustable table. A support member has a plate fixed to the crossmembers and provided with spindles having respective spindle nuts. One ends of the spindles are connected with a pedestal of the bed by means of ball bearings, the other ends bear a table of a frame or a surface supporting a patient. Preferably, spindles are provided with chain sprockets receiving a chain. One of the spindles is driven by any suitable means as, for example, a handwheel.

Instead of sprockets, gearwheels or rollers receiving cables can easily be used.

BRIEF DESCRIPTION OF THE DRAWINGS

The above and other objects, features and advantages of the invention will become more readily apparent from the following description, references being made to the accompanying drawing, in which.

SPECIFIC DESCRIPTION

Figure 1:
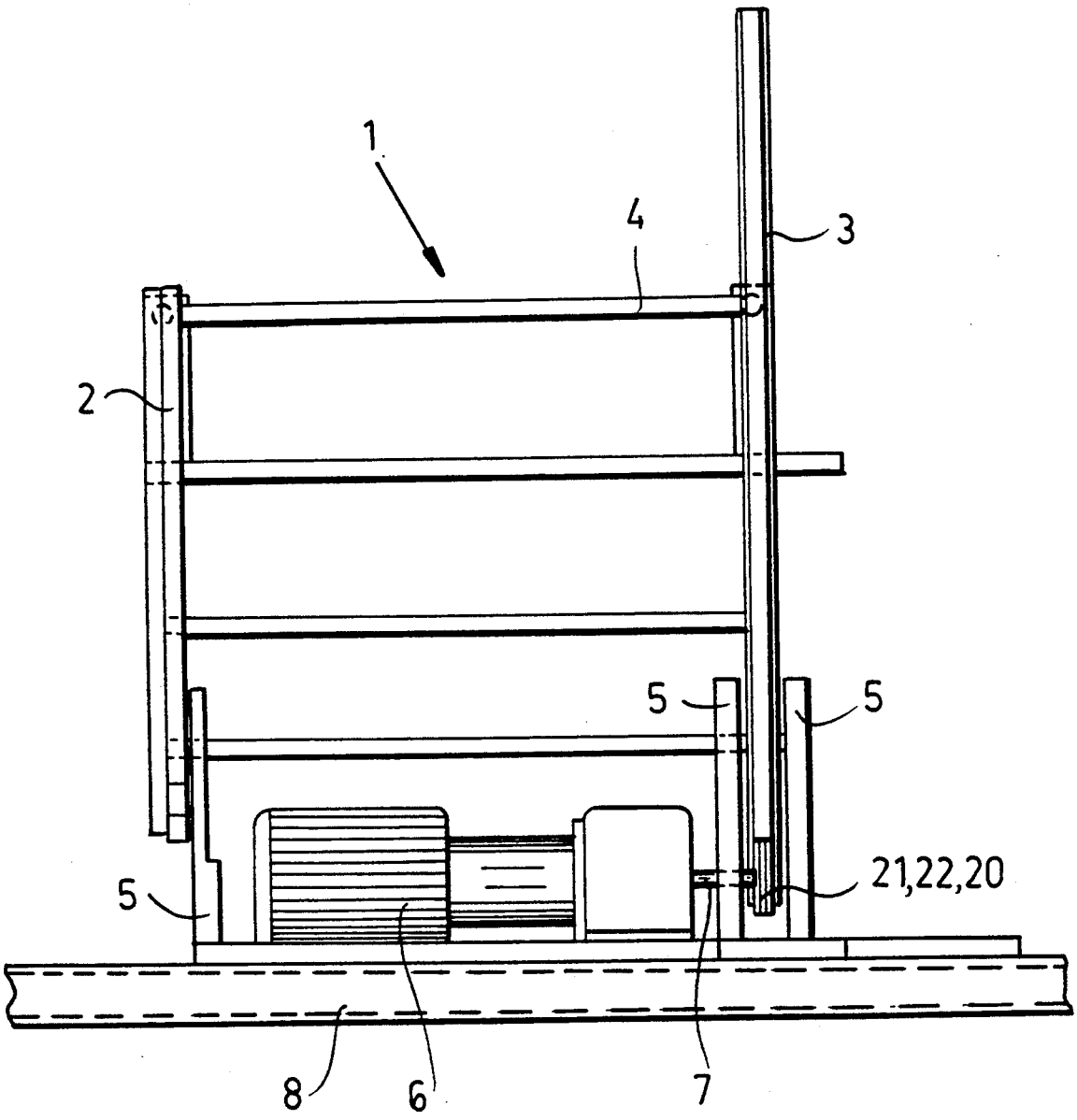
FIG. 1 is a side elevational view of a bed sub-structure.

FIG. 1 illustrates a bed sub-structure 1 having two synchronously pivoting circular segments 2 and 3. Curved disks can be utilized instead of the segments. The segments are bridged by crossmembers or spacer rods 4 extending generally parallel to a longitudinal axis of a bed. Stands 5 juxtaposed with respective segments support and guide the latter. Displacement of the sub-structure is effected by a motor 6 provided with a shaft 7 driving a central sprocket located below and connected with the segment 3. The stands and the motor are mounted on a foot 8 which can, preferably, be mounted on transporting means 38 for the bed as shown in FIG. 2.

Figure 2:
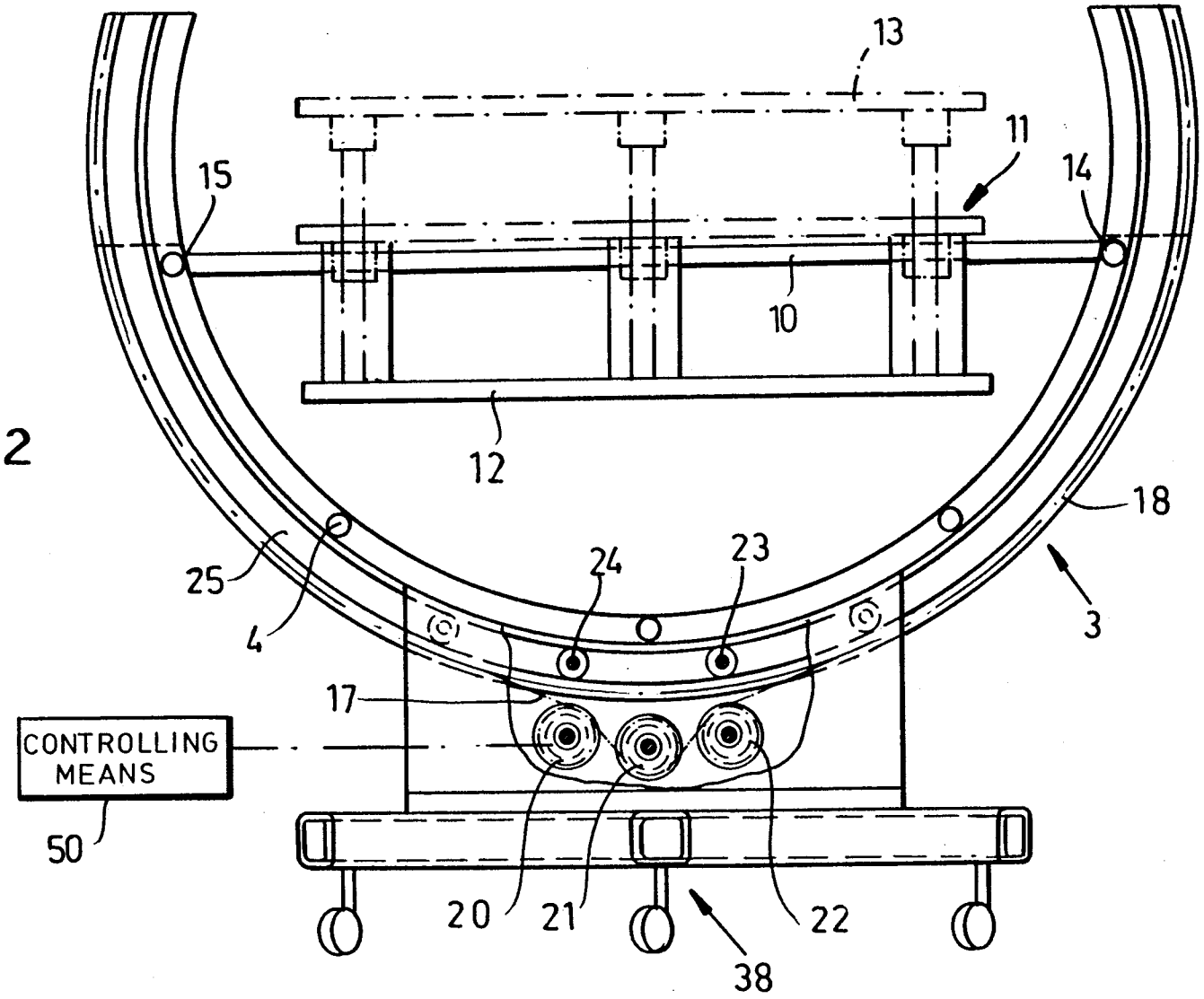
FIG. 2 is a front elevational view according to FIG. 1.

A profile of a circular segment 3 illustrated in FIG. 2 takes the form of an annular segment of a circle and has proved to be most convenient for operating in accordance with the present invention.

Figure 2A:
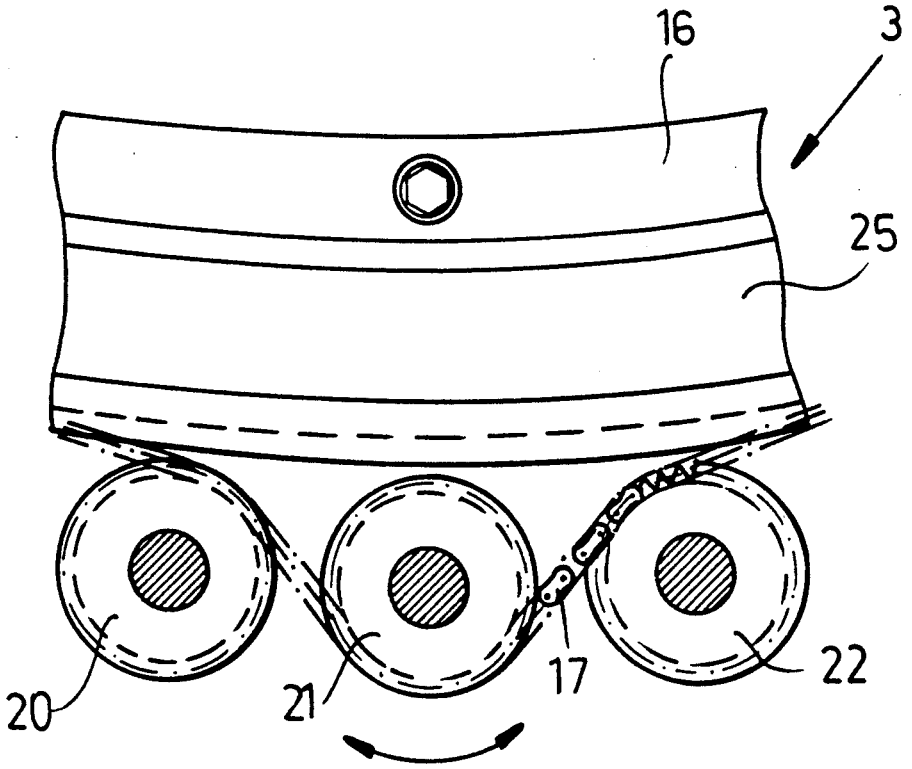
FIG. 2*a* is a detail view of chain sprockets.

Displacement of the segment is effected by a chain 17 which can be, for example, a roller chain running in a trough 18 extending along the entire circumference of the segment. The chain is secured to ends of a segment by any known method, for instance, my means of split-pins. According to an embodiment shown in FIG. 2, the chain 17 runs through three chain sprockets 20, 21 and 22 mounted rotatably on the respective stand 5. Only a central sprocket 21, as shown in FIG. 2*a*, is driven by the shaft 7 of the motor 6, while sprockets 20 and 22 are rotatable in a direction opposite to a direction of the central sprocket 21 upon engaging the chain.

As an important consequence of a structure having three sprockets, a relatively long section of the chain is engaged by teeth of sprockets ensuring, thereby, a continuous tensioning of the chain and contributing to a reduction of wear of the parts. Another consequence of the structure is the smooth transition between positions of the bed.

Figure 6:
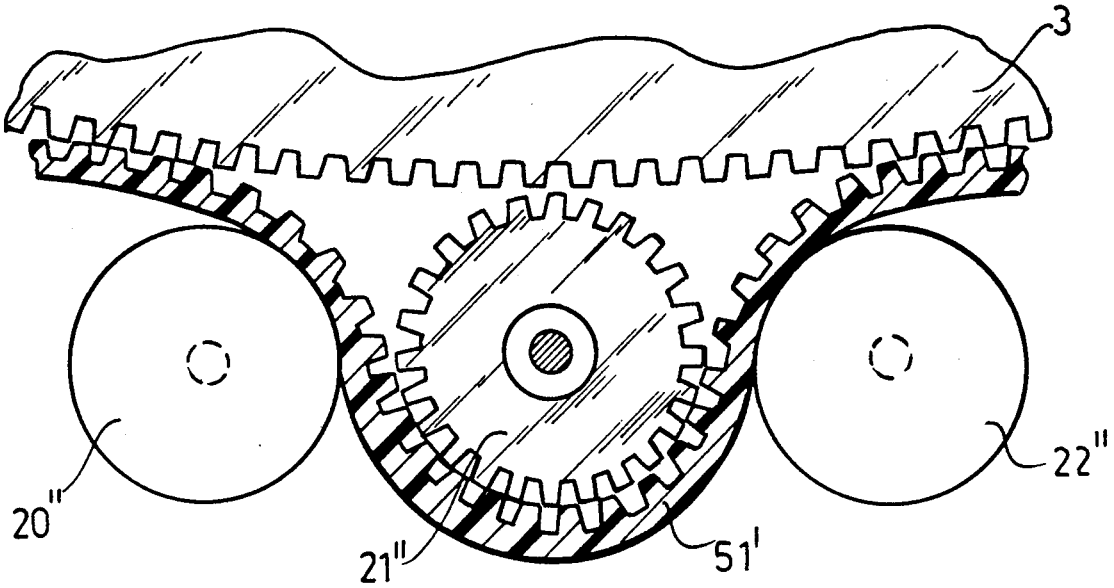
FIG. 6 is a side elevational view of a toothed belt in combination with a respective sprocket.
Figure 7:
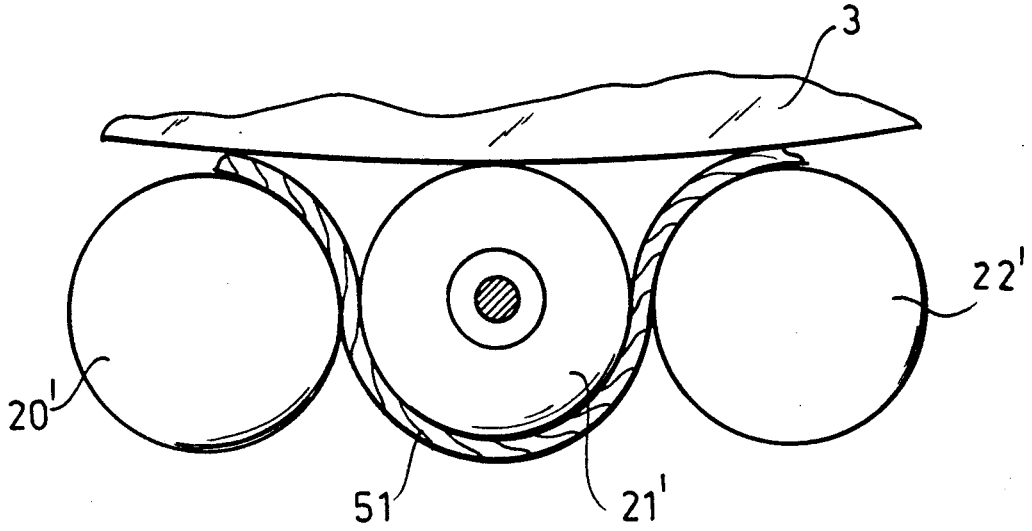
FIG. 7 is a diagrammatic view of a cable passing through rollers.

As illustrated in FIGS. 6 and 7, a chain with sprockets can be adequately replaced by either a pull cable 51 passing through a plurality of rollers and wound around a roller 21' several times for protecting a tensioning thereof or by a toothed-belt 51' engaged with a toothed-belt sprocket 21'' flanked by respective reversing sprockets 20'' and 22''. Depending upon one or both sides of the belt 51 are toothed, the sprockets 21'' is centrally installed or flanked by two reversal sprockets 20'' and 22''.

A degree of deflection of the segments as well as control of the speed are electronically controlled by regulating means 50 which can be operated by both a patient and medical personal.

Stands 5 are connected with respective segments by means of bolts 23 arranged in an arc configuration along a rail 25 and engaging the respective segment through respective ball bearings 24. The rails are a U-shaped indentation made on both sides of the segment. The ball bearings are approximately of a size equal to a width of the rail in order to stabilize a system upon the motion of segments.

As can be seen in FIG. 1, stands 5 are mounted on both sides of a directly driven segment 3 and respectively engage both sides of the segment. A segment 2 driven through crossmembers 4 is juxtaposed with only one stand 5. The spacer rods 4 provide a synchronous pivotable motion for both segments 2 and 3.

Figure 3:
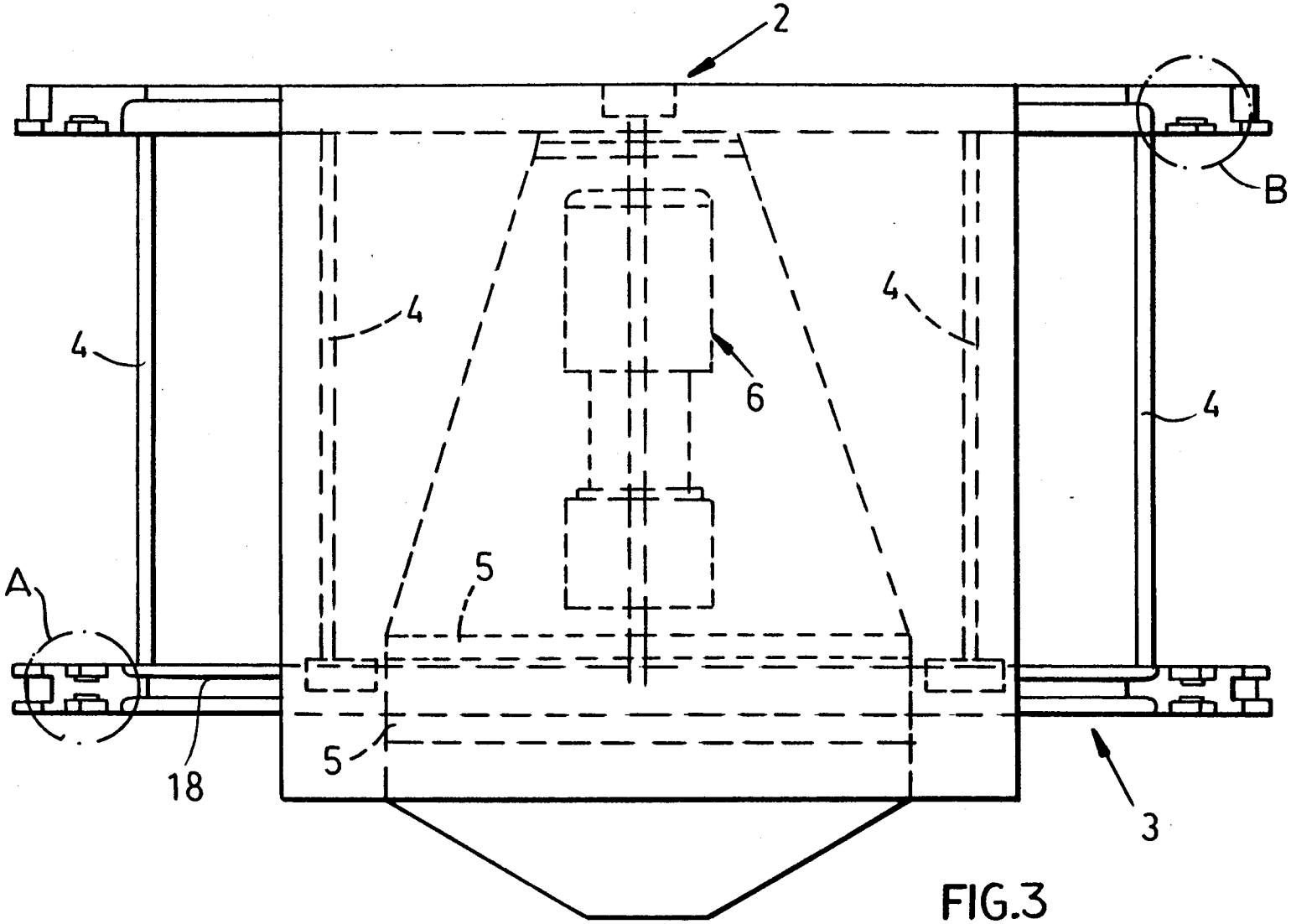
FIG. 3 is a top plan view of a sub-structure according to FIG. 1.
Figure 3B:
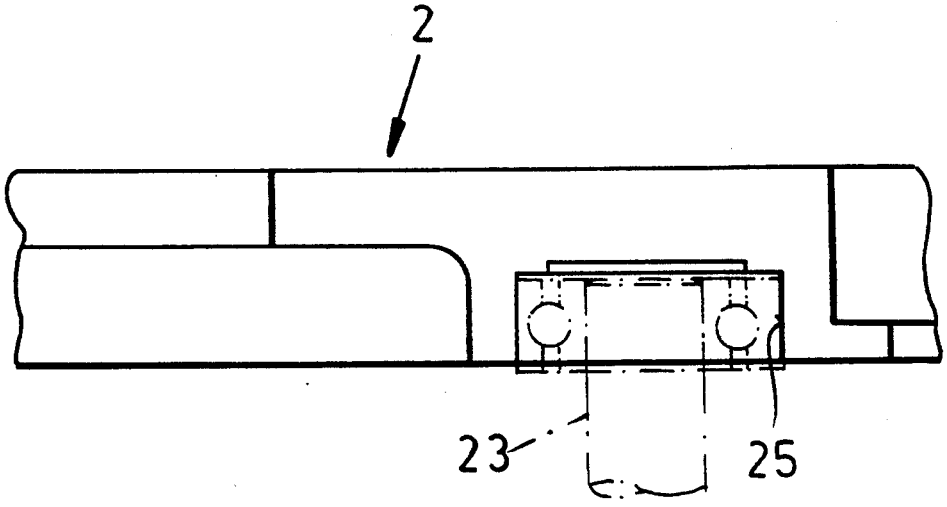
FIG. 3*b* is a detail view of a detail B of FIG. 3.
Figure 3A:
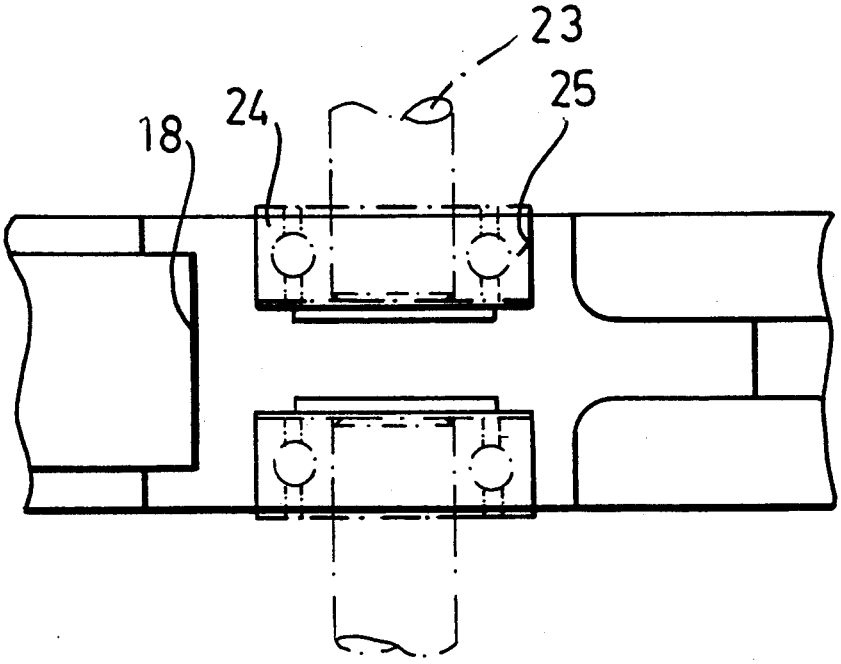
FIG. 3*a* is a detail view of a detail A of FIG. 3.

FIG. 3 shows a bed sub-structure 1 with respective bolts engaging both sides of the segment 3 and only one side of the segment 2. The segment 3 is formed with two rails 25 on both sides and with a trough 18 formed along the circumference of the segment. It is apparent from FIG. 3 that the segment 2 is not provided with a trough.

An arc of the segments is preferably 210°, although it can be varied in accordance with particular circumstances. It is possible to use even a circle. The drive system does not necessitate the utilization of circular segments for curved disks, but, can be used for any curvature.

A support surface system 11 illustrated in FIG. 2 is mounted on crossmembers 10 bridging the respective segments (only one of the segments being shown) and connecting a flange 16 of the respective segment by means for connecting 14 and 15, which could be bolts or screws. The support surface system 11 for a patient includes a support member 12 shown in FIG. 2 and connected With crossmembers 10 and a supporting table which is so adjustable that a pivoting axis of the table would coincide with a personal longitudinal axis of a patient by simply manipulating the height of the table in response to a patient's reaction.

Figure 4:
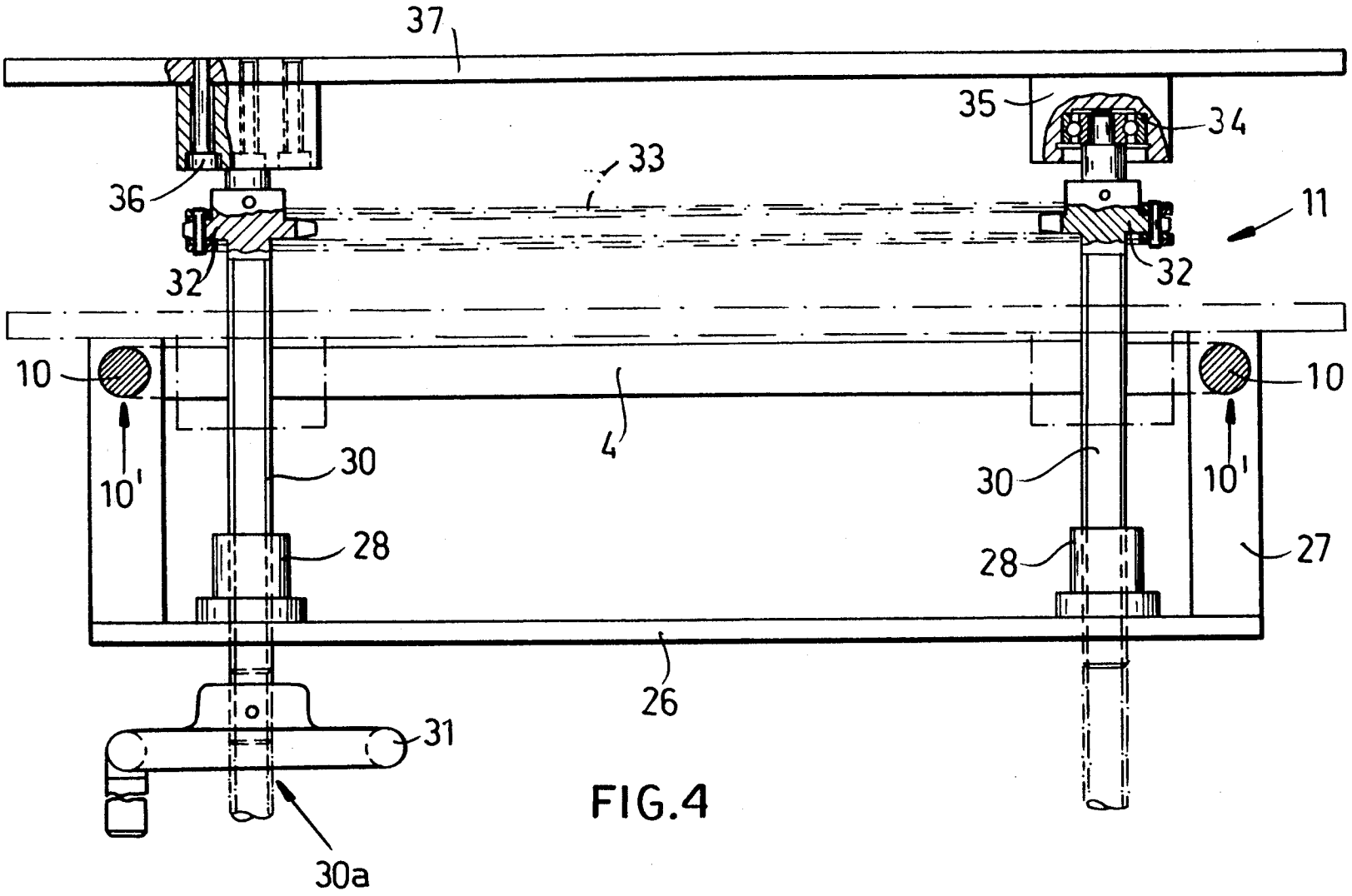
FIG. 4 is a side elevational view of a patient-surface system.
Figure 5:
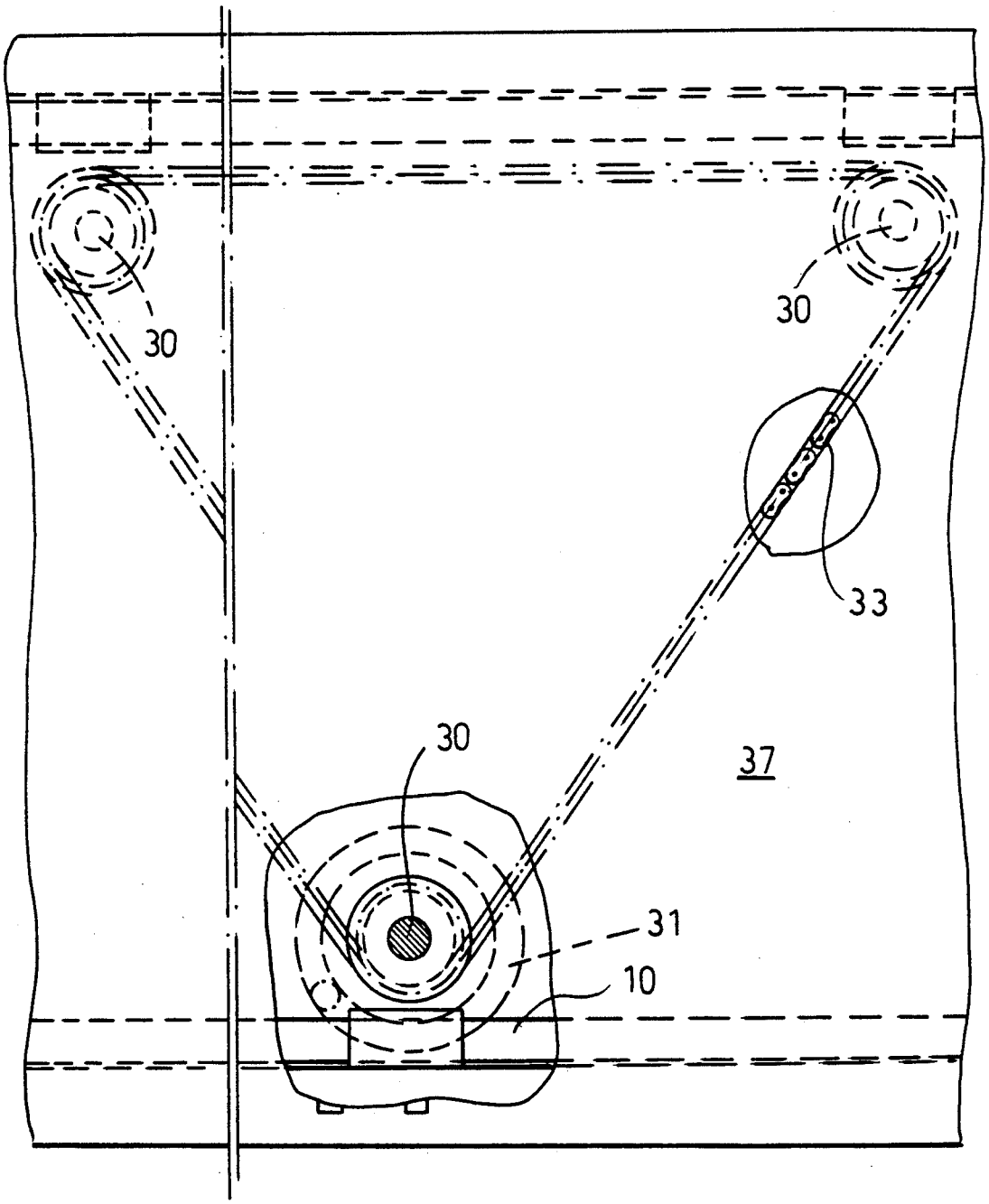
FIG. 5 is a top plan view of a support surface of a patient-surface system according to FIG. 4.

An embodiment of such a supporting table is shown in FIG. 4 and includes a plate 26 mounted on crossmembers 10 of the segments 2 and 3 by means of respective mountings 27 receiving, in turn, spacer bars 4 extending between the segments 2 and 3 and connected with crossmembers by any conventional means, for example, by bolts. The mountings 27 can be provided with respective openings 10' receiving corresponding crossmembers 10. The plate 26 is provided with a plurality of spindles 30 shown clearly in FIG. 5 and formed with respective screw threads engaging a spindle nut 28 urged against the plate 26. One of the spindles is provided with a handwheel 31 mounted on an end 30*a* thereof and having means for locking the wheel in any desirable position.

The table is formed with respective driving means including a chain 33 passing over chain sprockets 32 mounted on each of the spindles 30 by means of pins and spaced from the plate 26. Ends of spindles opposite that one end provided with the handwheel support the surface 37 with a patient thereon by means of pedestals 35 connected with the ends through bolts 36 and respective ball bearings 34. As a consequence, a pivoting axis of the table can be aligned with a longitudinal axis of a patient by mere rotation of the handwheel, either retracting or extending the spindle formed with the handwheel and transferring the motion of the latter to the rest of spindles by the chain 33 compensating thereby the irregularities caused by individual phisical features.

I claim:

1. A bed for immobile patients, comprising:

means for supporting a bed frame; and a sub-structure connected with said bed frame and mounted on said means for supporting and including:

a first stand and a second stand spaced axially apart and mounted on said means for supporting, each of said stands being provided with at least one roll bearing, a first and second axially spaced sectors pivotable about a pivoting axis and juxtaposed with the respective first and second stands, each of said sectors having a circumference and being formed with a respective U-shaped arcuate indentation running in a web of the sector, the circumference of at least one of said sectors being provided with a trough extending therealong, each of said stands being provided with at least one guiding element mounted in said roll bearing and engaging slidably the respective U-shaped indentation, a plurality of rollers juxtaposed with the circumference of said one sector and mounted rotatably on said first stand, and a flexible track element secured to opposite ends of said one sector, said track element being guided through said rollers and being received by said trough, so that said bed frame is pivotable about said pivoting axis without rough changes between angular positions thereof.

2. The bed defined in claim 1, further comprising means for driving including a motor provided with a shaft mounted on said one stand and driving one of said rollers, said flexible track element being a chain, said rollers being chain sprockets.

3. The bed defined in claim 2 wherein said flexible element is a pull cable wound over said one roller several times.

4. The bed defined in claim 2 wherein said flexible element is a toothed belt having opposite sides thereof, at least one of said sides being formed with teeth.

5. The bed defined in claim 1 wherein said one sector is juxtaposed with another stand connected with said first stand, said first and other stands flanking said one sector.

6. The bed defined in claim 1 wherein said first and second sectors are connected therebetween by a plurality of spacer rods extending generally parallel to said pivoting axis, said bed frame being mounted on said sectors and comprising:

a pair of cross members traversing said pivoting axis, each cross member of said pair bridging the respective sector, means for connecting said cross members with said spacer rods, a plurality of spaced apart spindles extending vertically perpendicular to said pivoting axis, each of said spindles being provided with a respective thread on one end thereof, an opposite end of each of said spindles being provided with a ball bearing and with a respective chain sprocket spaced from said ball bearing and receiving a chain connecting said spindles, a respective nut screwed on each of said one end and urged against a plate connected with said means for connecting and extending parallel to said pivoting axis, and a bed surface mounted on said opposite ends of said spindles and lying in a plane parallel to said pivoting axis.

7. The bed defined in claim 6 wherein one of said spindles is provided with a handwheel mounted on the respective one end of said one spindle, said spindles being retracted upon an actuation of said handwheel of said one spindle, so that said bed surface is generally vertically displaceable.

8. The bed defined in claim 1 wherein said guiding element is at least one bolt.

9. The bed defined in claim 1 wherein said sectors are disks.

10. The bed defined in claim 1 wherein said sectors are arcuate segments.

11. A bed for immobile patients, comprising:

means for supporting a bed frame; and a sub-structure mounted on said means for supporting and including:

a first sector and a second sector spaced axially apart and pivotable synchronously about a longitudinal axis, said sectors being connected with one another and having respective circumferences bridging opposite sides of each sector, at least one side of each of said sectors being formed with an arcuate indentation having a U-shaped cross-section and running along the respective side, the circumference of the first of said sectors being provided with a trough extending therealong, a plurality of rollers operatively connected with said means for supporting and juxtaposed with said trough for pivoting said sectors, a flexible track element passing over said rollers and being received by the trough of said first sector for smooth motion of said bed frame between angular positions of said sectors, and means for guiding said sectors operatively connected with said means for supporting and received by said indentation of each sector.

* * * * *